US009874131B2

(12) United States Patent
Ryu et al.

(10) Patent No.: US 9,874,131 B2
(45) Date of Patent: Jan. 23, 2018

(54) PUMP MODULE

(71) Applicants: HYUNDAI MOTOR COMPANY, Seoul (KR); Hyundam Industrial Co., Ltd., Asan-Si, Chungcheongnam-do (KR)

(72) Inventors: Bu Yeol Ryu, Hwaseong-Si (KR); Pil Seon Choi, Anyang-Si (KR); Chan Yo Jeon, Daejeon (KR); Bu Hyeon Cho, Asan-Si (KR); Yong Taek Hwang, Chungcheongnam-do (KR)

(73) Assignees: Hyundai Motor Company, Seoul (KR); Hyundam Industrial Co., Ltd., Asan-si, Chungcheongnam-do (KR)

( * ) Notice: Subject to any disclaimer, the term of this patent is extended or adjusted under 35 U.S.C. 154(b) by 212 days.

(21) Appl. No.: 14/938,239

(22) Filed: Nov. 11, 2015

(65) Prior Publication Data

US 2017/0030241 A1 Feb. 2, 2017

(30) Foreign Application Priority Data

Jul. 30, 2015 (KR) ..... 10-2015-0108334

(51) Int. Cl.

| | |
|---|---|
| ***F16K 49/00*** | (2006.01) |
| ***F01N 9/00*** | (2006.01) |
| ***F01N 3/20*** | (2006.01) |

(52) U.S. Cl.

CPC ..... *F01N 9/00* (2013.01); *F01N 3/206* (2013.01); *F01N 2610/02* (2013.01); *F01N 2610/10* (2013.01); *F01N 2610/1406* (2013.01); *F01N 2610/1426* (2013.01); *F01N 2610/1433* (2013.01); *F01N 2610/1486* (2013.01)

(58) Field of Classification Search

CPC ..... F01N 9/00; F01N 3/206; F01N 2610/10; F01N 2610/02; F01N 2610/1406; F01N 2610/1426; F01N 2610/1433; F01N 2610/1486; Y10T 137/6606; Y10T 137/794; Y10T 137/8122;

(Continued)

(56) References Cited

U.S. PATENT DOCUMENTS 9,611,866 B2 * 4/2017 Ryu ..... F04D 29/708
2008/0264048 A1 * 10/2008 Nishiyama ..... B01D 53/9431 60/299

(Continued)

FOREIGN PATENT DOCUMENTS

JP 2013-015140 A 1/2013
KR 10-2012-0135916 A 12/2012

(Continued)

*Primary Examiner* — Jessica Cahill
(74) *Attorney, Agent, or Firm* — McDermott Will & Emery LLP

(57) ABSTRACT

A pump module includes: a pump that is installed at the inside of a storage tank in order to discharge a liquid that is stored at the inside of the tank to the outside of the tank; a flange that is coupled to one side of the tank in order to couple the pump to the tank; a heater that is located on the flange so as to enclose a lower portion of the pump; a cover that covers an upper portion of the pump in order to couple the heater to the flange; and a filter that is coupled to the flange so as to enclose the pump, the cover, and the heater and that filters the liquid that is supplied to the pump.

29 Claims, 18 Drawing Sheets

(58) Field of Classification Search
CPC ..... Y10T 137/85978; F04B 23/021; F04B 23/023; F04B 53/08; F04B 53/20
USPC ..... 417/313, 360; 248/205.9
See application file for complete search history.

(56) References Cited

U.S. PATENT DOCUMENTS

| | | | | |
|---|---|---|---|---|
| 2012/0311999 | A1* | 12/2012 | Hodgson | F01N 3/2066 60/295 |
| 2013/0000743 | A1* | 1/2013 | Crary | F01N 3/2066 137/15.04 |
| 2013/0025269 | A1* | 1/2013 | Hodgson | F01N 3/2066 60/317 |
| 2014/0165973 | A1* | 6/2014 | Park | F02M 31/125 123/558 |
| 2014/0260212 | A1* | 9/2014 | Hodgson | F01N 3/206 60/297 |
| 2014/0352284 | A1* | 12/2014 | Maguin | B01D 29/21 60/295 |
| 2014/0373514 | A1* | 12/2014 | Bauer | F01N 3/2066 60/303 |
| 2015/0050168 | A1* | 2/2015 | Ryu | F04D 13/06 417/410.1 |

FOREIGN PATENT DOCUMENTS

| | | | |
|---|---|---|---|
| KR | 10-1490931 | B1 | 2/2015 |
| KR | 10-1510344 | B1 | 4/2015 |

* cited by examiner

PUMP MODULE

CROSS-REFERENCE TO RELATED APPLICATION

This application claims the benefit of priority to Korean Patent Application No. 10-2015-0108334 filed in the Korean Intellectual Property Office on Jul. 30, 2015, the entire contents of which are incorporated herein by reference.

BACKGROUND OF THE INVENTION (a) Field of the Invention

The present disclosure relates to a pump module.

(b) Description of the Related Art

In general, in order to reduce nitrogen oxide (NOx) that is contained in an exhaust gas, an exhaust system of a diesel engine has an exhaust gas post-processing apparatus such as Selective Catalyst Reduction (SCR), Diesel Oxidation Catalyst (DOC), and Catalyzed Particulate Filter (CPE).

An exhaust gas post-processing apparatus (hereinafter, referred to as an 'SCR apparatus') to which SCR is applied performs a function of reducing nitrogen oxide of an exhaust gas to nitrogen and oxygen by ejecting a reducing agent such as an urea aqueous solution to the inside of an exhaust pipe.

That is, in the SCR apparatus, when a reducing agent is ejected to the inside of the exhaust pipe, the reducing agent is converted to ammonia (NH3) by a heat of an exhaust gas, and as a catalyst reaction of nitrogen oxide and ammonia in an exhaust gas by an SCR catalyst, the nitrogen oxide may be reduced to a nitrogen gas (N2) and water (H2O).

In this way, in order to eject a urea aqueous solution to the inside of the exhaust pipe through the SCR apparatus, a urea aqueous solution supply system for supplying the urea aqueous solution to the SCR apparatus is required.

The urea aqueous solution supply system generally has a urea tank that stores a urea aqueous solution and a pump module that is formed in the urea tank and that supplies the urea aqueous solution to the SCR apparatus.

In the conventional art, it is difficult to assemble a pressure sensor in a flange and to dispose a plurality of components at a limited space. Further, a sensor, a pump terminal, and a heater that are mounted in the flange may be corroded by a urea aqueous solution of strong basicity.

In the conventional art, there is difficulty in stably pumping a strongly basic urea aqueous solution to an injector. Further, as a heating apparatus and a pump are installed at a predetermined distance, it is not easy to melt a frozen urea aqueous solution existing within the pump.

Further, in the conventional art, when a vehicle having a filter is inclined, particulates are not evenly filtered through the filter.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a pump module having advantages of being capable of stably pumping a strongly basic urea aqueous solution to an injector and preventing a sensor, a pump terminal, and a heater from being corroded by a urea aqueous solution.

The present invention has been made in an effort to further provide a pump module having advantages of being capable of melting a urea aqueous solution that is frozen in a winter season and disposing a plurality of components at a limited space.

An exemplary embodiment of the present invention provides a pump module including: a pump that is installed at the inside of a storage tank in order to discharge a liquid that is stored at the inside of the tank to the outside of the tank; a flange that is coupled to one side of the tank in order to couple the pump to the tank; a heater that is located on the flange so as to enclose a lower portion of the pump; a cover that covers an upper portion of the pump in order to couple the heater to the flange; and a filter that is coupled to the flange so as to enclose the pump, the cover, and the heater and that filters the liquid that is supplied to the pump.

The flange may include: a flange body including a receiving portion that is installed at one surface of the inside of the tank and having one surface in which the pump is installed and the other surface in which a printed circuit board (PCB) is housed; and a flange cover that is coupled to the flange body so as to seal the PCB, wherein a first exhaust pipe of the pump that is installed in the flange body may be extended to the flange side and be connected to a second exhaust pipe that is formed at the other surface side of the flange body of the outside of the tank.

The receiving portion may include: a first receiving groove in which the PCB and the second exhaust pipe are installed; and a first wall portion that is formed at the circumference of the first receiving groove, wherein the first wall portion may be coupled to the flange cover.

The first wall portion may include: a first surface having a penetration hole that inserts and penetrates one end portion of the second exhaust pipe; and a second surface that forms the first receiving groove together with the first surface by connecting both end portions of the first surface.

A height of the first surface may be higher than that of the second surface, the first surface may have a constant height, and a height of the second surface may reduce in a predetermined angle as receding from the first surface.

The second surface may have a round shape, and the predetermined angle may be 5° to 20°.

The pump module may further include: an installation groove that is formed to insert the PCB at one surface of the first receiving groove; a second wall portion that is formed at the circumference of the installation groove; and a PCB cover that couples to the second wall portion to cover and seal the PCB.

At one surface of the installation groove, a first groove into which a level sensor is inserted and a second groove into which a concentration sensor is inserted may be formed, and in an upper portion of the level sensor and the concentration sensor, the PCB may be installed.

At one surface of the flange cover, a mounting hole may be formed, wherein the pump module may further include a ventilation member that is inserted and fixed to the mounting hole.

The heater may have a first mounting groove that houses at least a portion of the pump and heat at least a portion of the pump and at least a portion of the first exhaust pipe and the second exhaust pipe.

The heater may include: a heater body that is extended in an inner direction of the tank; and a positive temperature coefficient (PTC) element that is coupled to an outer side surface of the heater body, wherein the first mounting groove may be formed in an end portion that is opened in an inner direction of the tank of the heater body.

The heater body may include: a third wall portion that is formed at the circumference of a second mounting groove that is formed at one side surface of the heater body in order to insert the PTC element; and a PTC cover that is coupled to the heater body in order to cover and seal the PTC element, wherein the PTC cover may be coupled to the third wall portion to cover and seal the PTC element and to fix the PTC element to the heater body.

At the one surface of the flange, a second receiving groove may be formed to house at least a portion of the first exhaust pipe, and at the second receiving groove, one end portion of the heater body that can heat at least a portion of the first exhaust pipe may be housed together with at least a portion of the first exhaust pipe.

At the inside of the second receiving groove of the flange, a connection pipe that connects the first exhaust pipe and the second exhaust pipe that are extended and protruded in the heater direction may be formed, wherein the pump module may further include a straight line type ejection pipe that is coupled to the first exhaust pipe, and the ejection pipe may be located within the connection pipe in a state that is coupled to the first exhaust pipe.

The cover may include: a cover member that has a third receiving groove that houses a portion of the pump including a terminal of the pump at one side; a terminal guide that is formed in an outer portion of the cover member and in which a connection terminal that is connected and extended to the terminal is located therein; and a coupler that is formed at one side of the cover member to couple the cover member to the flange.

A terminal of the pump may be formed at an upper side surface of an upper end portion of the pump, the connection terminal may be bent twice in a '⊏' shape to be extended to the flange side, and one end portion thereof may be connected to a terminal of the pump, and the other end portion thereof may be extended in a lower side direction of the pump.

In the pump, a first diameter of an upper end portion in which a terminal of the pump is formed may be smaller than a second diameter of a central portion of the pump, and the inside of the third receiving groove of the cover member may have a step portion to correspond to a first diameter of an upper end portion of the pump and a second diameter of a central portion of the pump.

At the third receiving groove of the cover member, a first sealing member and a second sealing member corresponding to the first diameter and the second diameter, respectively, may be installed.

At one surface of the pump, a terminal hole may be formed, at the inside of the terminal hole, the terminal may be located, and the terminal hole and an end portion of the connection terminal may be coupled with shape customization.

An upper portion of the heater may be extended to the inside of the third receiving groove so as to enclose an upper portion of a side surface of the pump and be disposed between the cover members of the pump.

At an outer side surface of the heater, a coupling protrusion that is protruded to the cover member side may be formed, and in the cover member, a first hole that inserts and couples the coupling protrusion may be formed.

The coupler may include a latch jaw that is protruded to the pump side and having an end portion to be protruded in an outside direction, and in the cover member, a second hole in which the latch jaw is inserted and coupled may be formed.

A relief sensor may be coupled to one end portion of the terminal guide, in an upper end portion of the pump, a coupling groove that is depressed in an inner direction may be formed, at an inner surface of the coupling groove, a terminal hole of the pump may be formed, and in a central portion of the coupling groove, an outlet in which the liquid may flow may be formed.

The pump module may further include a discharge pipe having one end portion that is inserted into the outlet and the other end portion that is connected to the relief sensor.

The filter may include: a filter housing that is coupled on the flange that is installed at one surface of the inside of the tank and that forms a hollow portion therein to install the pump therein; and a filter unit that is formed at one side of the filter housing and that filters the liquid that is supplied to the pump.

The filter housing may be formed in a cylindrical shape and may include an upper surface portion that is located in an upper portion of the pump; and a side surface portion that encloses a side surface of the pump.

The filter unit may be formed in a side surface portion of the filter housing and may include a plurality of filter members, the plurality of filter members each may include: a plane-shaped filter medium that is formed in a corrugated form; and a frame that is installed at the circumference of the filter medium in order to support the filter medium.

The plurality of filter members may be radially arranged at a predetermined gap in the side surface portion.

At the inside of the filter housing, a flow channel pipe that is opened in a vertical direction may be formed, and at one surface of the flange that is connected to a lower end portion of the flow channel pipe, the level sensor may be installed.

The filter unit may have a filtration area of 450 $cm^2$ or more.

DETAILED DESCRIPTION OF THE EMBODIMENTS

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Figure 1:
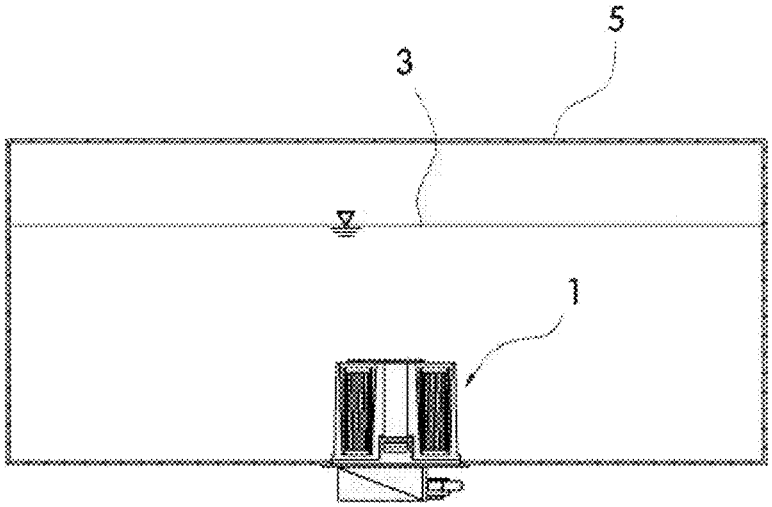
FIG. 1 is a perspective view illustrating a pump module that is installed at the inside of a tank according to an exemplary embodiment of the present invention.
Figure 2:
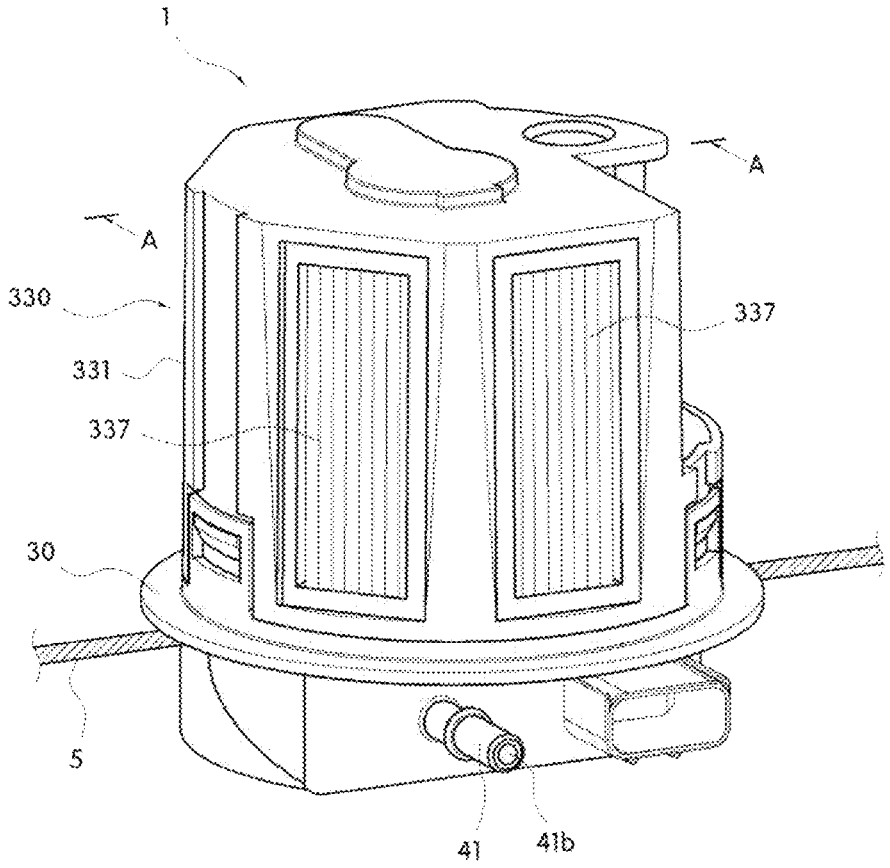
FIG. 2 is a perspective view illustrating a pump module according to an exemplary embodiment of the present invention.
Figure 3:
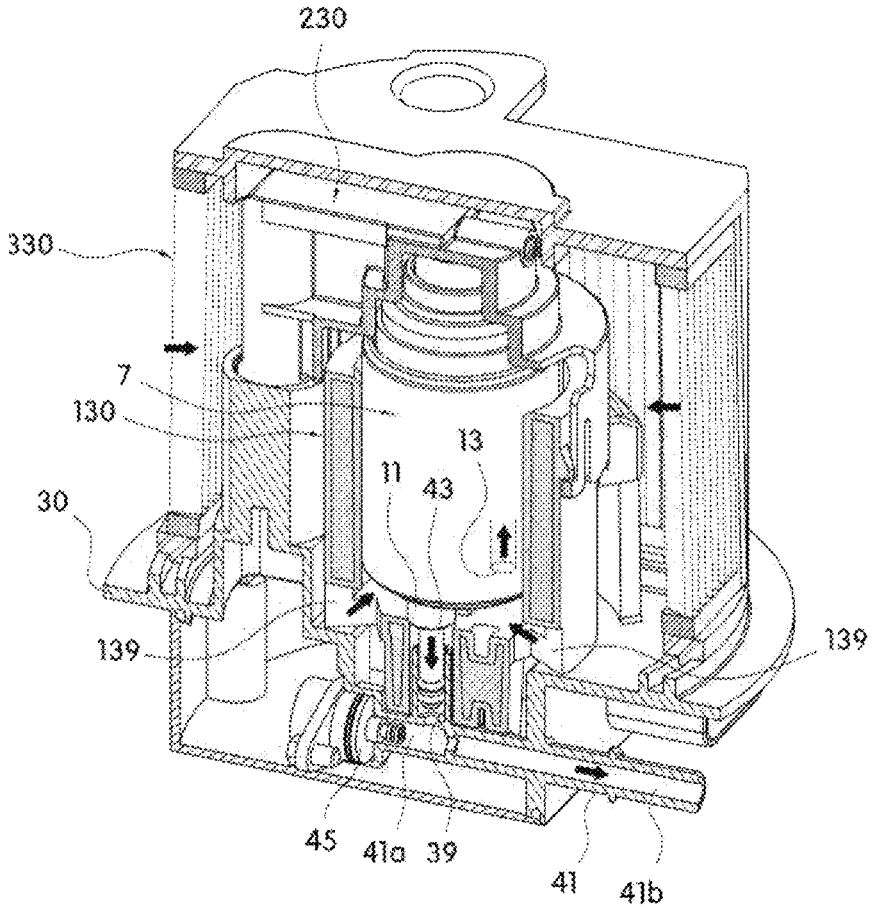
FIG. 3 is a cross-sectional view taken along a line A-A of FIG. 2 and an arrow represents a movement of a liquid.

FIG. 1 is a perspective view illustrating a pump module that is installed at the inside of a tank according to an exemplary embodiment of the present invention. FIG. 2 is a perspective view illustrating a pump module according to an exemplary embodiment of the present invention. FIG. 3 is a cross-sectional view illustrating the pump module taken along a line A-A of FIG. 2 and an arrow represents a movement of a liquid.

Referring to FIGS. 1 to 3, a pump module 1 according to an exemplary embodiment of the present invention may include a pump 7, a flange 30, a heater 130, a cover 230, and a filter 330.

In this case, the pump module 1 is installed at the inside of a tank 5 at which a liquid is stored to stably pump a liquid to an injector (not shown) that is installed at the outside of the tank 5. Further, the pump module 1 includes a flange 30 that performs a temperature, level, and filter function of a liquid that is stored at the tank 5 and that is mounted in a lower portion of the tank 5 and thus a configuration component of the pump module 1 is simply installed.

Referring to FIGS. 1 and 2, in an exemplary embodiment of the present invention, a liquid that is stored at the inside of the storage tank 5 may be a urea aqueous solution 3 that is used as a reducing agent. In this case, the urea aqueous solution 3 has no color, odor, poison, and combustibility and has strong basicity (PH10 or more) and is mixed with a ratio of 32.5% in water.

The pump module 1 is installed at the inside of the tank 5 in which the urea aqueous solution 3 is stored to stably pump a strongly basic urea aqueous solution to an injector (not shown) that is installed at the outside of the tank 5.

Referring to FIG. 3, in an exemplary embodiment of the present invention, the pump 7 is installed at the inside of the tank 5 and pumps the urea aqueous solution 3 that is stored at the inside of the tank 5 to the outside of the tank 5.

As shown in FIG. 3, in the pump 7, a suction pipe 13 and a first exhaust pipe 11 may be adjacently formed at a lower side surface of the pump 7. Therefore, the urea aqueous solution 3 is inhaled to the inside of the pump 7 through the suction pipe 13 that is formed at a lower side surface of the pump 7 and is discharged to the outside of the pump 7 through the first exhaust pipe 11.

The suction pipe 13 and the first exhaust pipe 11 of the pump 7 are adjacently installed and thus the urea aqueous solution 3 that is inhaled through the suction pipe 13 does not pass through a motor (not shown) that is located at the inside of the pump 7 but is directly discharged through the first exhaust pipe 11, thereby protecting the motor.

Figure 4:
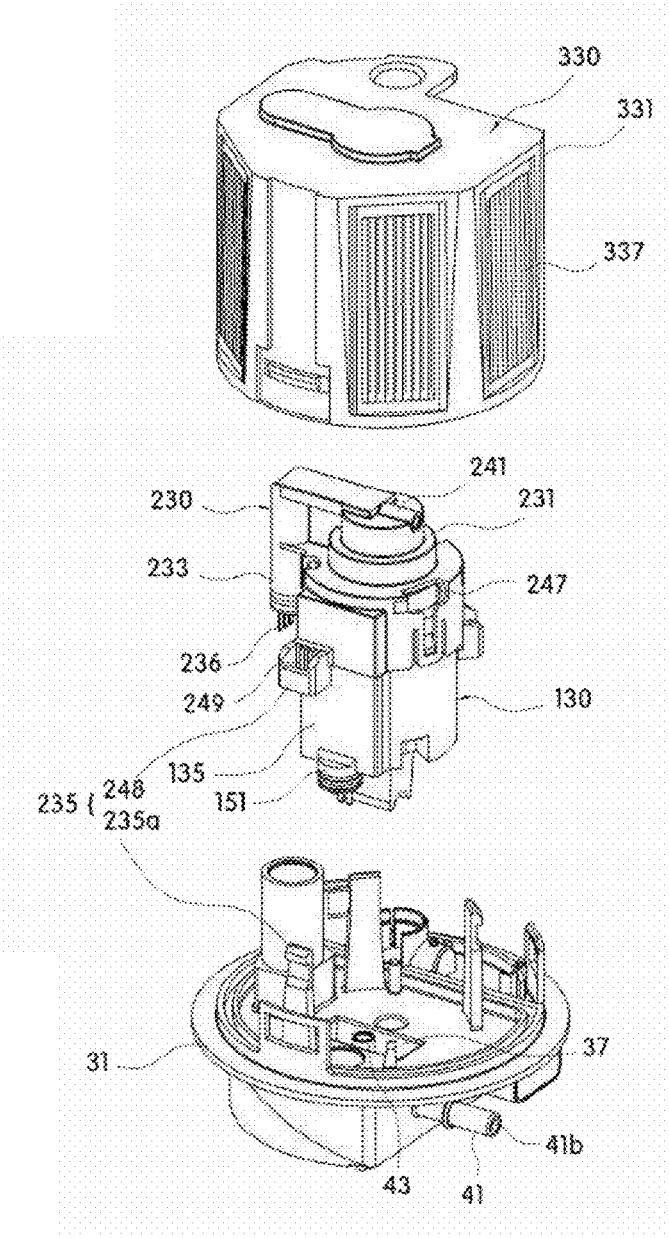
FIG. 4 is an exploded perspective view illustrating a pump module according to an exemplary embodiment of the present invention.
Figure 5:
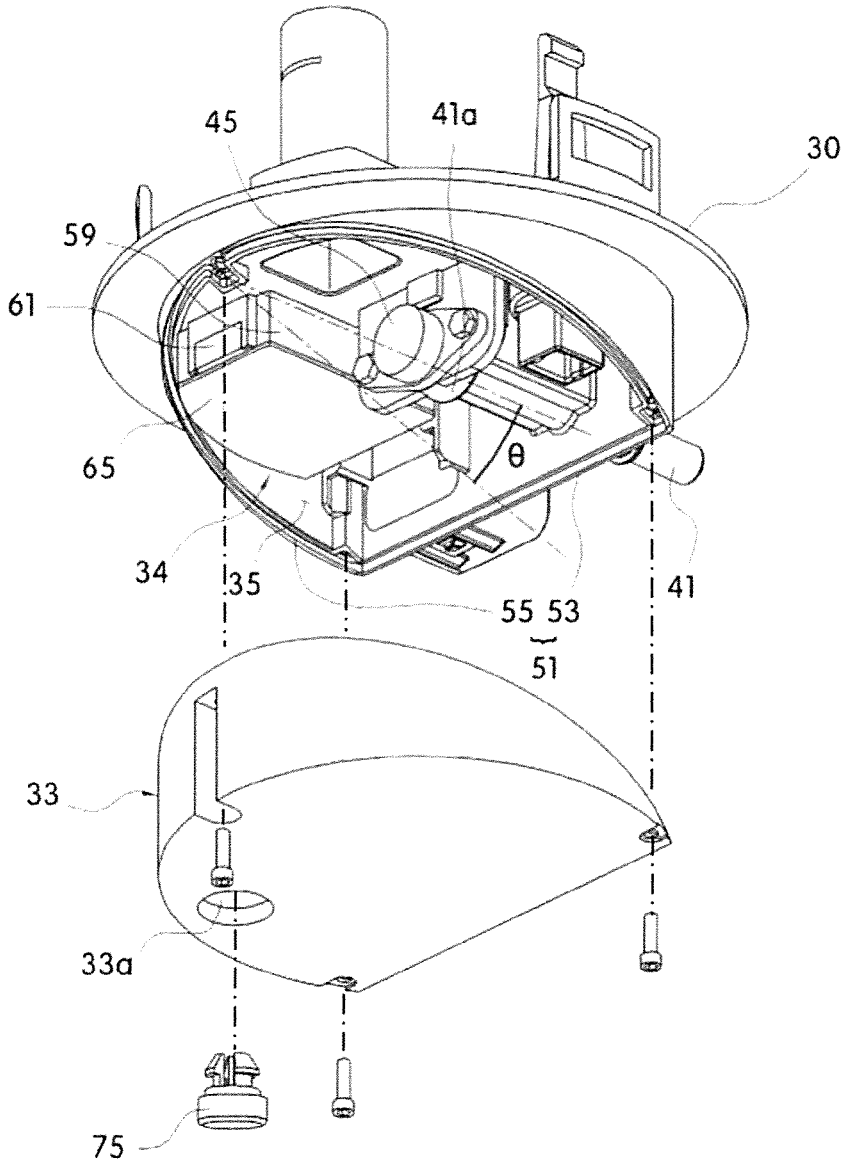
FIG. 5 is a perspective view illustrating a flange of a pump module according to an exemplary embodiment of the present invention.
Figure 6:
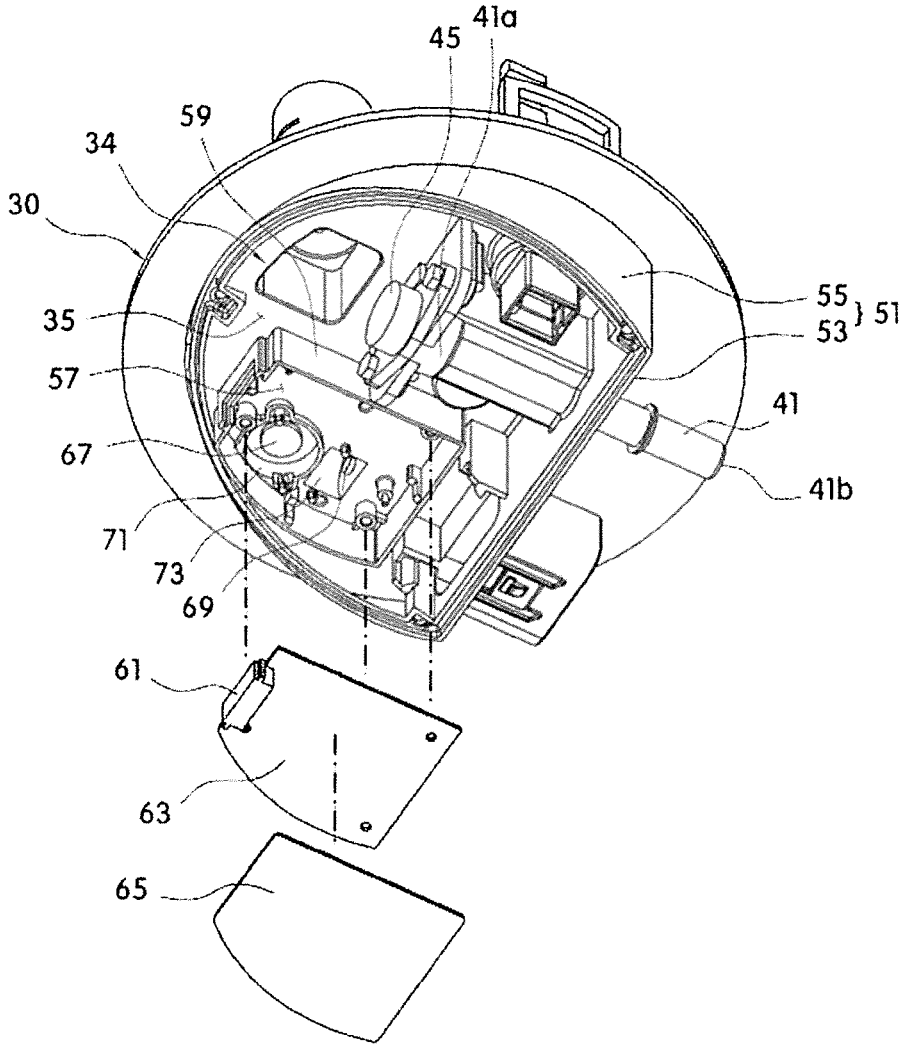
FIG. 6 is a perspective view illustrating a PCB that is mounted in a flange of a pump module according to an exemplary embodiment of the present invention.

FIG. 4 is an exploded perspective view illustrating a pump module according to an exemplary embodiment of the present invention. FIG. 5 is a perspective view illustrating a flange of a pump module according to an exemplary embodiment of the present invention. FIG. 6 is a perspective view illustrating a PCB that is mounted in a flange of a pump module according to an exemplary embodiment of the present invention.

Referring to FIGS. 4 to 6, the flange 30 according to an exemplary embodiment of the present invention may include a flange body 31, a PCB 63, and a flange cover 33. In this case, the flange 30 includes a flange body 31, and at the inside of the tank 5, the pump 7 and the heater 130 may be thus installed.

Referring to FIGS. 3 and 4, the flange body 31 is installed at one surface of the inside of the tank 5, i.e., at a lower side surface of the tank 5, as shown in FIG. 2 to block a hole (not shown) that is formed in a lower portion of the tank 5.

In this case, referring to FIG. 4, the pump 7, the heater 130, the filter 330, and the cover 230 are installed at one surface, for example, an upper surface of the flange body 31 to be fixed at the inside of the tank 5.

Further, referring to FIG. 6, at the other surface, for example, a lower surface of the flange body 31, a receiving portion 34 that houses the PCB 63 may be included. Further, a lower surface of the flange body 31 is exposed to the outside of the tank 5 to discharge the urea aqueous solution 3 to the outside of the tank 5.

Referring to FIGS. 4 to 6, the flange body 31 may be a circular plate having a circular cross-section and may include a first wall portion 51 that protrudes in a lower direction of the circular plate. In this case, the flange body 31 may be a resin injection material that is produced by injection molding with a resin.

Referring to FIGS. 3 and 4, at an upper surface of the flange body 31, a second receiving groove 37 is formed, and at the second receiving groove 37, a connection pipe 39 may be provided. Further, in a lower portion of the flange body 31, a second exhaust pipe 41 that is connected to the connection pipe 39 may be provided.

In an exemplary embodiment of the present invention, the second receiving groove 37 of the flange 30 may be formed at one surface of the flange 30, for example, at an upper surface of the flange 30, as shown in FIG. 4.

Referring to FIGS. 3 and 4, at the second receiving groove 37, at least a portion of the first exhaust pipe 11 that is formed at a lower side surface of the pump 7 may be received.

Further, at the second receiving groove 37, one end portion of the heater 130, for example, a lower side end portion of the heater 130 may be received together with at least a portion of the first exhaust pipe 11. Therefore, at least a portion of the first exhaust pipe 11 may be heated by the heater 130.

The heater 130 may include a heating member 131 that generates a heat at one side and a first plug 151 that can supply electrical energy to the heating member 131. Further, although not shown, a socket may be formed in the flange body 31.

Referring to FIG. 3, the second exhaust pipe 41 is a passage that discharges the urea aqueous solution 3 to the outside of the flange body 31. In this case, one end portion of a heater body 135 may be formed to heat a portion of the second exhaust pipe 41.

That is, in order to heat a portion of the second exhaust pipe 41, a protruded lower side end portion of the heater body 135 may extend a horizontal direction.

In this case, in order to heat a portion of the second exhaust pipe 41, the protruded lower side end portion of the heater body 135 may be formed to correspond to a shape of the second exhaust pipe 41. As shown in FIG. 4, a shape of the second exhaust pipe 41 may be a circular pipe shape, and in this case, a lower side end portion of the heater body 135 may be formed to enclose a portion of an upper portion of the second exhaust pipe 41 in a half-circle shape.

Referring to FIGS. 5 and 6, in an exemplary embodiment of the present invention, the second exhaust pipe 41 may be formed at the other surface side of the flange body 31, for example, at a lower portion of the flange 30, as shown in FIG. 5.

Referring to FIG. 3, a first inlet 41*a* of the second exhaust pipe 41 is connected to the connection pipe 39, and an outlet 41*b* of the second exhaust pipe 41 is extended in a horizontal direction to penetrate a first surface 53 of the first wall portion 51, which is a side surface of the flange body 31, as shown in FIG. 5, thereby being exposed to the outside of the flange 30.

In an exemplary embodiment of the present invention, at an internal surface of the second receiving groove 37 of the flange body 31, the connection pipe 39 that connects the first exhaust pipe 11 and the second exhaust pipe 41 may be formed, as shown in FIGS. 3 and 4.

In this case, the connection pipe 39 may be protruded at an inner surface of the second receiving groove 37 in a direction of the heater 130.

Referring to FIG. 3, within the connection pipe 39, a discharge pipe 43 may be installed in a vertical direction. The discharge pipe 43 may be formed in a straight line shape and may be coupled to the first exhaust pipe 11 of the pump 7.

In this case, in order to seal between the discharge pipe 43 and the connection pipe 39, at an outer circumferential surface of the discharge pipe 43, a sealing member (not shown) may be formed.

As shown in FIG. 6, in one end portion of the second exhaust pipe 41, for example, in the first inlet 41*a*, a pressure sensor 45 may be mounted. The pressure sensor 45 compares a present actual measured pressure and a target pressure and feedback controls in real time a pressure of the urea aqueous solution 3.

In an exemplary embodiment of the present invention, the first exhaust pipe 11, the second exhaust pipe 41, the connection pipe 39, and the discharge pipe 43 may have a pipe form having a circular cross-section so that the urea aqueous solution 3 may move, but are not limited thereto.

Referring to FIGS. 5 and 6, in an exemplary embodiment of the present invention, at a lower surface of the flange body 31, the receiving portion 34 that houses the PCB 63 may be included. In an exemplary embodiment of the present invention, the flange 30 includes a PCB 63, thereby enabling electricity to flow without an electric wire.

In an exemplary embodiment of the present invention, the receiving portion 34 may include a first receiving groove 35 and a first wall portion 51. In this case, at the first receiving groove 35 of the flange body 31, the PCB 63 and the second exhaust pipe 37 may be installed.

Thereby, in an exemplary embodiment of the present invention, by sealing without exposure to the outside in a state in which the PCB 63 is housed in the receiving portion 34 of the flange body 31, the flange 30 may be stably fixed.

Referring to FIG. 6, in an exemplary embodiment of the present invention, the first receiving groove 35 may have a half-circular shape, but is not limited thereto and may have any shape in which the PCB 63, a level sensor 67, a concentration sensor 69, and the second exhaust pipe 41 may be installed.

Further, in an exemplary embodiment of the present invention, as the flange body 31 is depressed in an inner direction, the first receiving groove 35 may be formed, but as shown in FIG. 6, in an edge portion of the flange body 31, a first wall portion 51 having a height is formed and thus the first receiving groove 35 may be formed.

The first wall portion 51 may protrude at the circumference of the first receiving groove 35. In this case, the first wall portion 51 is coupled to the flange cover 33 to seal the PCB 63, the level sensor 67, and the concentration sensor 69 that are installed at the inside of the first receiving groove 35 from the urea aqueous solution 3.

Referring to FIG. 6, in an exemplary embodiment of the present invention, the first wall portion 51 may include a first surface 53 and a second surface 55. In this case, at the first surface 53, a penetration hole (not shown) that inserts and penetrates a portion of the second exhaust pipe 41 may be formed.

In an exemplary embodiment of the present invention, the outlet 41*b* of the second exhaust pipe 41 is inserted into the penetration hole to be exposed to the outside of the flange body 31. Thereby, the outlet 41*b* may discharge the urea aqueous solution 3 that is stored at the inside of the tank 5 to the outside of the tank 5.

Referring to FIGS. 5 and 6, the first surface 53 may have a plate shape having a quadrangular cross-section. By connecting both end portions of the first surface 53, the second surface 55 may form the first receiving groove 35 together with the first surface 53. That is, the first surface 53 and the second surface 55 may be a closed curved surface that can form the first receiving groove 35 therein.

In this case, the second surface 55 may have a round shape that is connected to the first surface 53. In this case, the first receiving groove 35 may have a half-circle shape that is formed with the first surface 53 and the second surface 55, but is not limited thereto and may have any shape that forms a closed curved surface to seal.

Referring to FIG. 6, a height of the first wall portion 51 may not be uniform. That is, the first surface 53 may have a height higher than that of the second surface 55.

Further, the first surface 53 has a constant height, and a height of the second surface 55 may reduce in a predetermined angle T as receding from the first surface 53. In this case, a predetermined angle T may be 5° to 20°.

This is because when installing the pressure sensor 45 in a second inlet 139 of the second exhaust pipe 41, if a height of the second surface 55 adjacent to the first inlet 41*a* is high, upon mounting the pressure sensor 45, interference may occur.

Therefore, in an exemplary embodiment of the present invention, by lowering a height of the second surface 55 adjacent to the first inlet 41*a*, the pressure sensor 45 may be easily mounted.

Figure 7:
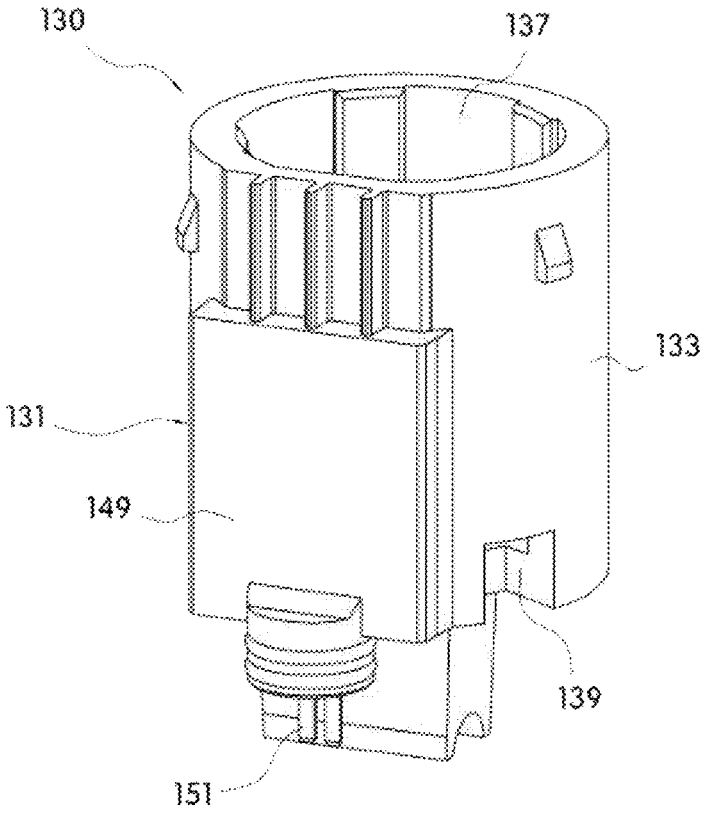
FIG. 7 is a perspective view illustrating a heater of a pump module according to an exemplary embodiment of the present invention.

In an exemplary embodiment of the present invention, at one surface of the first receiving groove 35, for example, at a lower surface of the first receiving groove 35, an installation groove 57 may be formed to insert the PCB 63, as shown in FIG. 7.

Thereby, in an exemplary embodiment of the present invention, by completely separating from an external environment such as a temperature and humidity while electrically insulating the PCB 63 from the outside, the flange 30 may prevent moisture and a foreign substance from invading.

A second wall portion 59 may be protruded at the circumference of the installation groove 57. In this case, the second wall portion 59 is coupled to a PCB cover 65 to seal the PCB 63, the level sensor 67, and the concentration sensor 69 that are installed within the installation groove 57 from the urea aqueous solution 3.

Referring to FIG. 6, in an exemplary embodiment of the present invention, a fixing member 61 may be protruded to couple the PCB 63 and the second wall portion 59. In this case, the PCB 63 may be coupled to the fixing member 61 in which at least one end portion is protruded in an external direction at one side.

Thereby, in an exemplary embodiment of the present invention, the flange 30 may couple and fix the PCB 63 to the second wall portion 59.

As shown in FIG. 6, the fixing member 61 is a quadrangle having a quadrangular cross-section, and both end portions of the quadrangle may be protruded. Further, one surface of the second wall portion 59 may be formed to insert the fixing member 61.

Referring to FIG. 6, in an exemplary embodiment of the present invention, at one surface of the installation groove 57, a first groove 71 into which the level sensor 67 is inserted and a second groove 73 into which the concentration sensor 69 is inserted may be formed.

In this case, the level sensor 67 may be an ultrasonic wave level sensor. The ultrasonic wave level sensor measures a water level with a method of shooting ultrasonic waves to a target, measuring and converting a time in which the ultrasonic waves reflect and return, and calculating a distance from the target.

Further, the concentration sensor 69 may detect a concentration of the urea aqueous solution 3.

Referring to FIG. 6, the level sensor 67 may be vertically installed, and the concentration sensor 69 may be horizontally installed. Accordingly, a horizontal length of the first groove 71 may be longer than a vertical length thereof, and a vertical length of the second groove 73 may be longer than a horizontal length thereof.

Further, at the upper portion side of the level sensor 67 and the concentration sensor 69, the PCB 63 may be installed. Thereby, in an exemplary embodiment of the present invention, by sealing the PCB 63, the flange 30 may together seal the level sensor 67 and the concentration sensor 69, thereby reducing a production cost and simplifying a process.

Referring to FIG. 6, in an exemplary embodiment of the present invention, in order to cover and seal the PCB 63, the PCB cover 65 may be coupled to the second wall portion 59.

In this case, by performing laser welding a circumferential edge of the PCB cover 65, the PCB cover 65 may be coupled to the second wall portion 59. In an exemplary embodiment of the present invention, in a state in which the PCB 63, the level sensor 67, and the concentration sensor 69 are inserted into the installation groove 57, the first groove 71, and the second groove 73, by sealing the grooves with the PCB cover 65, the PCB 63, the level sensor 67, and the concentration sensor 69 may be integrally mounted in the flange body 31.

The PCB cover 65 has the same shape as that of the PCB 63 and may have any shape of a size that can cover the PCB 63.

Referring to FIG. 6, in an exemplary embodiment of the present invention, the flange 30 may include a flange cover 33. In order to seal the PCB 63, the level sensor 67, and the concentration sensor 69 that are coupled to the receiving portion 34 of the flange body 31, the flange cover 33 may be coupled to the flange body 31.

In an exemplary embodiment of the present invention, the flange cover 33 may be coupled to the first wall portion 51. In this case, in an end portion of at least one of the flange cover 33 and the first wall portion 51, a sealant (not shown) may be applied.

Referring to FIGS. 5 and 6, the flange cover 33 may be formed to correspond to the first surface 53 and the second surface 55 of the first wall portion 51. One end portion of the flange cover 33 coupling to the first surface 53 may have a height lower than that of the other end portion of the flange cover 33 coupling to the second surface 55.

Therefore, one end portion of the flange cover 33 coupling to the first surface 53 may have a plate shape having a quadrangular cross-section, as in a shape of the first surface 53. Similarly, the other end portion of the flange cover 33 coupling to the second surface 55 may have a round shape, as in a shape of the second surface 55.

In this case, a height of the flange cover 33 may be formed to correspond to the first surface 53 and the second surface 55. That is, at a lower surface of the flange body 31, a height of the flange cover 33 that is coupled to the first wall portion 51 may be the same.

By coupling to the first surface 53 and the second surface 55, the flange cover 33 may seal the first receiving groove 35 that is formed in the flange body 31. Therefore, the flange cover 33 may have a half-circle shape that can seal the first surface 53 and the second surface 55.

Referring to FIG. 5, at one surface, for example, an upper surface of the flange cover 33, a mounting hole 33*a* that can insert and fix a ventilation member 75 may be formed. In this case, the mounting hole 33*a* may have a circular cross-section and an internal radius and an external radius may be different, but the mounting hole 33*a* may have any shape according to an installed ventilation member 75.

In an exemplary embodiment of the present invention, the ventilation member 75 of the flange 30 may use a product "AVS 200" of "Polyvent compact series" of GORE company. The ventilation member 75 is a general content and will be thus omitted.

The ventilation member 75 is inserted into the mounting hole 33*a* to be coupled the flange cover 33. Further, at an outer circumferential surface of the ventilation member 75, a sealing member (not shown) is formed to be sealed with the mounting hole 33*a*.

Figure 8:
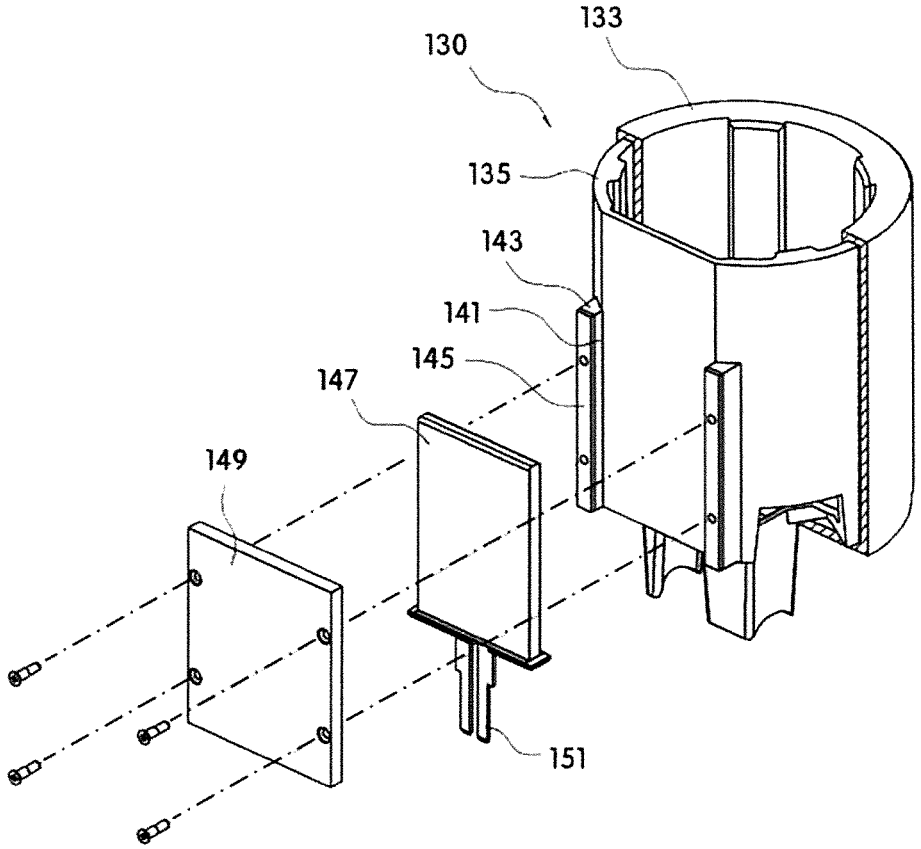
FIG. 8 is a perspective view illustrating a PTC element that is coupled to a heater body of a pump module according to an exemplary embodiment of the present invention.

FIG. 7 is a perspective view illustrating a heater of a pump module according to an exemplary embodiment of the present invention. FIG. 8 is a perspective view illustrating a PTC element that is coupled to a heater body of a pump module according to an exemplary embodiment of the present invention.

Referring to FIG. 7, in an exemplary embodiment of the present invention, the heater 130 may include a heating member 131, a housing 133, a heater body 135, a PTC element 147, and a flange 30. In this case, the heater 130 includes a heating member 131 and thus transfers a heat to the pump 7 to melt a frozen urea aqueous solution 3.

In an exemplary embodiment of the present invention, the heater 130 includes the PTC element 147, and at least a portion of the pump 7 and at least a portion of the first exhaust pipe 11 and the second exhaust pipe 41 transfer a heat to melt the frozen urea aqueous solution 3.

Further, in view of a characteristic of the PTC element 147, when an electrical overload is applied, power is blocked to prevent damage due to an electrical overload.

Referring to FIGS. 1 and 3, the heater body 135 may be extended in an internal direction of the tank 5, and for example, as shown in FIG. 3, the heater body 135 may be extended in a vertical direction of the tank 5.

In an exemplary embodiment of the present invention, referring to FIG. 8, in the housing 133, the heater body 135 that transfers a heat may be installed therein. The housing 133 may be a resin injection material that is produced by injection molding the heater body 135 with a resin. Therefore, a shape of the heater body 135 and a shape of the housing 133 may be the same.

Further, referring to FIGS. 7 and 8, in the heater body 135, a first mounting groove 137 may be formed in an end portion that is opened in an internal direction of the tank 5, for example, in an end portion that is opened in an upper direction of the tank 5, as shown in FIG. 3.

In this case, at the first mounting groove 137 that is formed within the heater body 135, the pump 7 may be inserted and installed in a vertical direction. Further, as shown in FIG. 7, at a lower side surface of the heater body 135, a plurality of second inlets 139 may be formed, and the plurality of second inlets 139 may be connected to the suction pipe 13 of the pump 7.

In this case, the urea aqueous solution 3 may be injected into the pump 7 through the suction pipe 13 of the pump 7 via the second inlet 139 of the heater body 135.

Referring to FIG. 8, the heater body 135 may be made of an aluminum material and may be formed in a cylindrical shape having a circular cross-section. However, in order to couple the PTC element 147 to an outer side surface, one side surface of the heater body 135 may be formed in a plate shape.

Further, as the pump 7 is located at the inside of the heater body 135, the heater body 135 encloses the pump 7 and directly transfers a heat occurring in the heater body 135 to the pump 7.

In this case, as shown in FIG. 8, the PTC element 147 may be formed in a plate shape having a quadrangular cross-section, and may receive the supply of electrical energy to generate a heat in view of a characteristic of the PTC element 147.

Referring to FIG. 8, in an exemplary embodiment of the present invention, at one side surface of the heater body 135, a second mounting groove 141 is formed to insert the PTC element 147. Further, at the circumference of the second mounting groove 141, a third wall portion 143 may be protruded.

In an exemplary embodiment of the present invention, the PTC element 147 may be coupled to the heater body 135 through a PTC cover 149. In this case, while covering and sealing the PTC element 147, the PTC cover 149 may enable the PTC element 147 to be coupled to the heater body 135.

Referring to FIG. 8, the PTC cover 149 may have a quadrangular cross-section, but may have any shape that covers and seals the PTC element 147.

Referring to FIG. 8, in an exemplary embodiment of the present invention, the PTC cover 149 may be coupled to the third wall portion 143 that is protruded at the circumference of the second mounting groove 141. By coupling to the third wall portion 143, the PTC cover 149 may cover and seal the PTC element 147, thereby fixing the PTC element 147 to the heater body 135.

In this case, by installing a gasket 145 between the third wall portion 143 and the PTC cover 149, the gasket 145 may seal between the third wall portion 143 and the PTC cover 149. The gasket 145 may prevent the urea aqueous solution 3 from penetrating the PTC element 147.

In an exemplary embodiment of the present invention, the heater 130 may include a power blocking means (not shown).

The power source block means may be a power source sensor, and the power source sensor is electrically connected to the PTC element 147 to block power that is supplied to the PTC element 147 when a temperature of the PTC element 147 is a Curie temperature or more. In this case, a Curie temperature is a temperature in which a material loses magnetism.

Referring to FIG. 8, in a lower side end portion of the PTC element 147, a second plug 236 is formed to supply electrical energy to the PTC element 147. The second plug 236 is electrically connected to the PTC element 147.

Referring to FIG. 4, in an exemplary embodiment of the present invention, in order to couple the heater 130 and the pump 7, a cover 230 is provided.

In this case, the cover 230 is coupled to the outside of the pump 7 to couple the heater 130 to the flange 30, thereby fixing the heater 130 to the inside of the tank 5.

Figure 9:
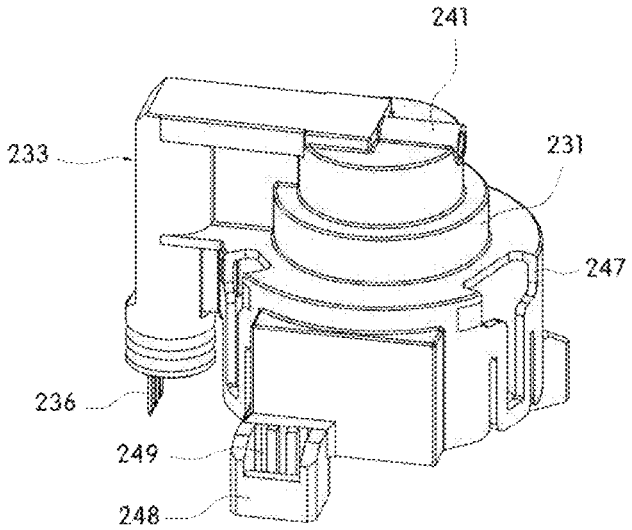
FIG. 9 is a perspective view illustrating a cover of a pump module according to an exemplary embodiment of the present invention.
Figure 10:
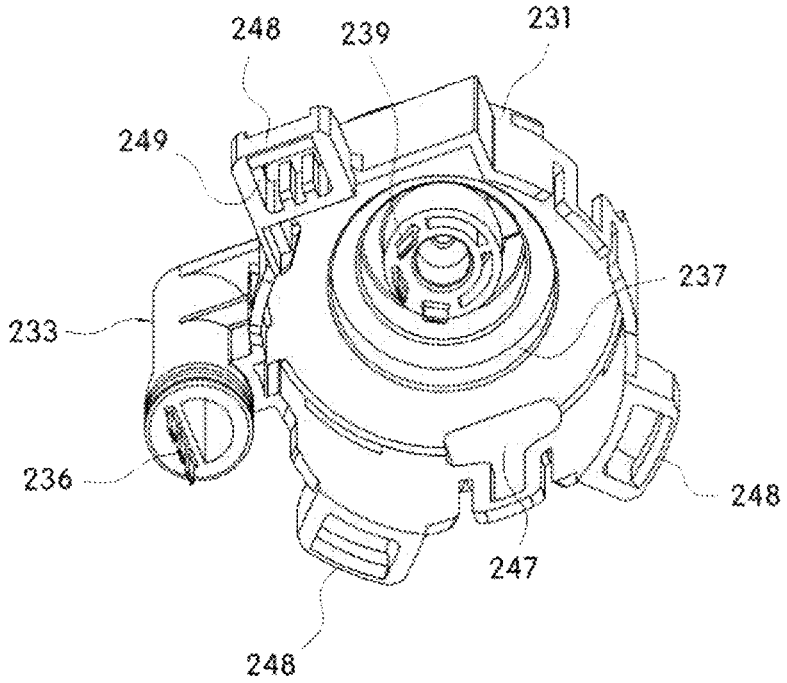
FIG. 10 is a bottom view illustrating a cover of a pump module according to an exemplary embodiment of the present invention.
Figure 11:
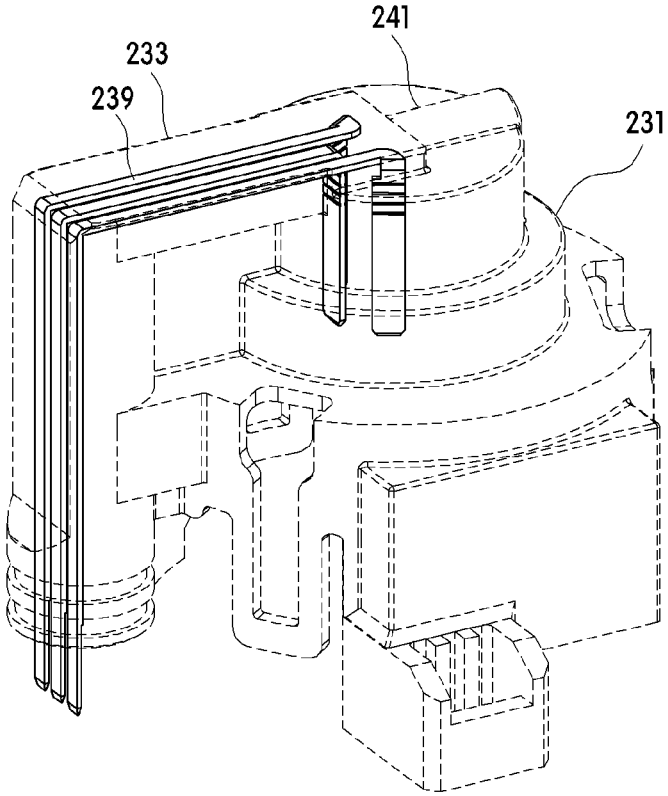
FIG. 11 is a perspective view illustrating a connection terminal that is mounted in a cover of a pump module according to an exemplary embodiment of the present invention.
Figure 12:
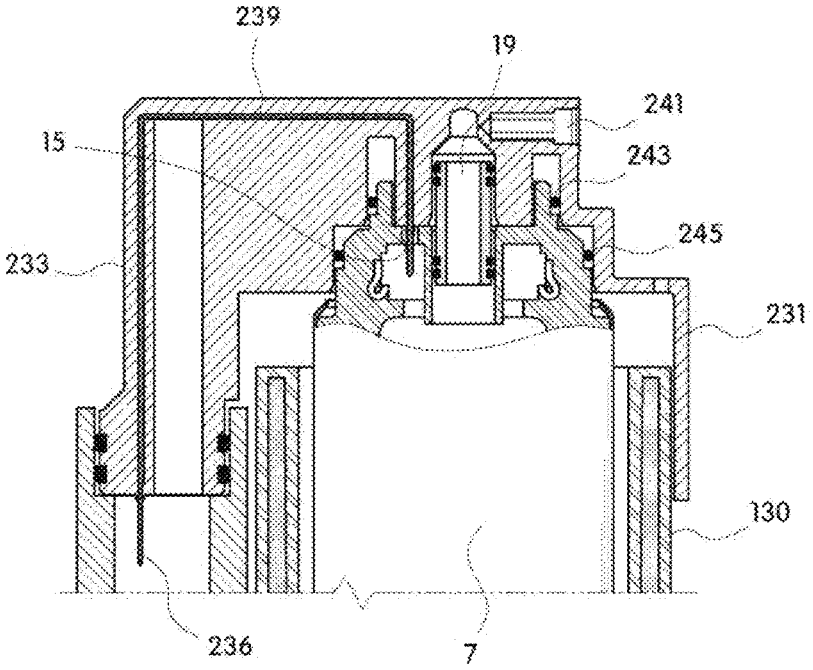
FIG. 12 is a cross-sectional view illustrating an upper portion of a cover of a pump module according to an exemplary embodiment of the present invention.
Figure 13:
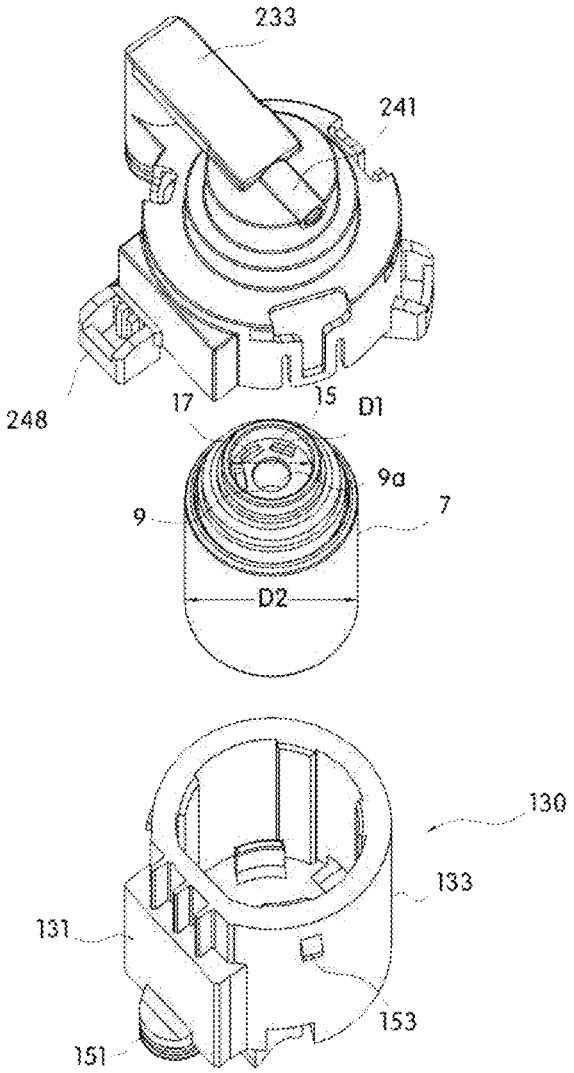
FIG. 13 is an exploded perspective view illustrating a cover, a pump, and a heater of a pump module according to an exemplary embodiment of the present invention.

FIG. 9 is a perspective view illustrating a cover of a pump module according to an exemplary embodiment of the present invention. FIG. 10 is a bottom view illustrating a cover of a pump module according to an exemplary embodiment of the present invention. FIG. 11 is a perspective view illustrating a connection terminal that is mounted in a cover of a pump module according to an exemplary embodiment of the present invention. FIG. 12 is a cross-sectional view illustrating an upper portion of a cover of a pump module according to an exemplary embodiment of the present invention. FIG. 13 is an exploded perspective view illustrating a cover, a pump, and a heater of a pump module according to an exemplary embodiment of the present invention.

Referring to FIGS. 9 to 13, in an exemplary embodiment of the present invention, the cover 230 may have a third receiving groove 237 that houses a portion of the pump 7 including a terminal 17 of the pump 7 at one side, for example, an upper surface.

Thereby, in an exemplary embodiment of the present invention, the cover 230 covers the terminal 17 of the pump 7 to prevent the terminal 17 from being corroded due to a contact with the urea aqueous solution 3. Further, in order to install the pump 7, the cover 230 may be coupled on one surface of the flange 30 that is installed at one surface of the inside of the tank 5. Thereby, by installing the pump 7 and the heater 130 at an upper surface of the flange 30, the pump 7 and the heater 130 may be fixed to the inside of the tank 5.

Referring to FIG. 4, in an exemplary embodiment of the present invention, the cover 230 may include a cover member 231, a terminal guide 233, and a coupler 235. In an exemplary embodiment of the present invention, the cover 230 includes a cover member 231 to cover the terminal 17 of the pump 7 and prevents the urea aqueous solution 3 from penetrating to the terminal 17 of the pump 7.

Referring to FIGS. 9 and 10, in order to cover at least a portion of the pump 7, the cover member 231 may be formed in a cylindrical shape, but may be formed in any shape that can cover a portion of the pump 7 of a cylindrical shape.

Referring to FIG. 9, the cover member 231 may have a third receiving groove 237 that is depressed in an inner direction. In this case, in the third receiving groove 237, an upper portion of the pump 7 is housed, and the cover member 231 covers an upper portion of the pump 7.

Referring to FIG. 13, the terminal 17 of the pump 7 may be formed at an upper side surface of an upper end portion of the pump 7. At an upper surface of the pump 7, at a constant gap, three terminal holes 15 may be formed. Further, at the inside of the three terminal holes 15, the terminal 17 of the pump 7 that receives the supply of power may be disposed.

In this case, the pump 7 may be formed with a three phase power terminal to provide a more stable and strong current to the pump 7.

An upper end portion and a central portion of the pump 7 may have a shape in which two cylinders having different diameters are coupled. In this case, the upper end side of the pump 7 in which the terminal 17 of the pump 7 is formed may be formed in a cylindrical shape having a first diameter D1.

Further, a central portion of the pump 7 may be formed in a cylindrical shape having the second diameter D2. In this case, the first diameter D1 may be formed smaller than the second diameter D2.

In an exemplary embodiment of the present invention, the cover 230 effectively prevents the urea aqueous solution 3 from being injected into the pump terminal 17, thereby beforehand preventing the pump terminal 17 from being corroded.

Therefore, referring to FIG. 13, the inside of the third receiving groove 237 of the cover member 231 may be formed to have a step portion to correspond to a first diameter D1 of an upper end portion of the pump 7 and the second diameter D2 of a central portion of the pump 7.

Thereby, in an exemplary embodiment of the present invention, the pump 7 and the cover member 231 may be coupled to seal through shape customization.

Referring to FIG. 12, at the third receiving groove 237 of the cover member 231, a first sealing member 243 and a second sealing member 245 corresponding to a first diameter D1 and a second diameter D2, respectively, may be installed.

Figure 14:
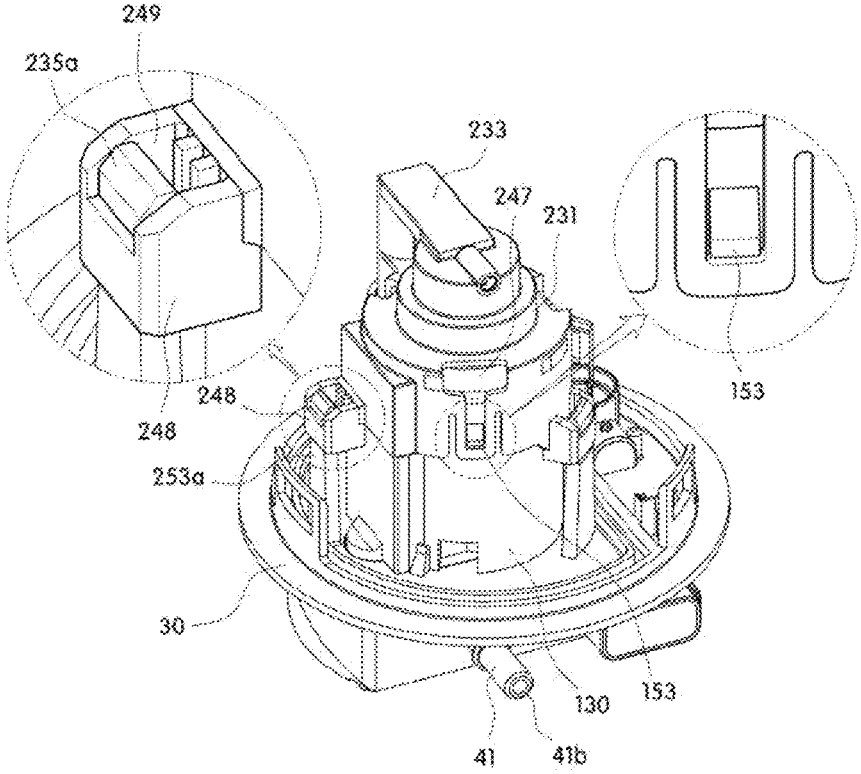
FIG. 14 is a perspective view illustrating a cover, a pump, and a heater that are mounted in a pump module according to an exemplary embodiment of the present invention.

FIG. 14 is a perspective view illustrating a cover, a pump, and a heater that are mounted in a pump module according to an exemplary embodiment of the present invention.

Referring to FIGS. 13 and 14, in an exemplary embodiment of the present invention, at an outer side surface of the heater 130, a coupling protrusion 153 that is protruded toward the cover member 231, i.e., in an external direction may be formed. In this case, the cover member 231 may have a first hole 247 to which the coupling protrusion 153 is inserted and coupled.

Referring to FIGS. 9 to 13, the flange 30 may include a coupler 235 that is coupled to the cover 230 at a periphery of the second receiving groove 37. The coupler 235 may include a latch jaw 235*a* that is protruded toward the pump 7 and in which an end portion is protruded in an external direction.

In this case, a latch 248 that is coupled to correspond to the latch jaw 235*a* may be formed in plural at a side surface portion of the cover member 231 having a cylindrical shape. Further, the latch 248 has a second hole 249 in which the latch jaw 235*a* is inserted and coupled to have a shape similar to a pipe shape.

In this case, the latch 248 includes a second hole 249 that is opened in a vertical direction and thus an end portion that is protruded in an external direction of the latch jaw 235*a* may be supported and coupled to an upper surface of the latch 248.

The latch 248 may have a quadrangular cross-section shape. Further, at the inside of the latch 248, in order to easily insert and couple the latch jaw 235*a*, a guide member (not shown) may be formed.

Further, as shown in FIG. 9, the first hole 247 may be extended toward an upper portion of the pump 7. Thereby, the pump module 1 according to an exemplary embodiment of the present invention may reduce a force in which an upper portion of the pump 7 receives when a volume of the urea aqueous solution 3 expands due to freezing.

Referring to FIGS. 9 and 10, in an outer portion of the cover member 231, a terminal guide 233 may be formed. At the inside of the terminal guide 233, a connection terminal 239 is located and thus the terminal guide 233 may protect the connection terminal 239.

In this case, the terminal guide 233 may be formed in an 'r' shape, but the connection terminal 239 that connects the terminal 17 is located therein and thus the terminal guide 233 may be formed in any shape that can seal the connection terminal 239.

Referring to FIG. 11, the connection terminal 239 is connected to the terminal 17 of the pump 7 to be bent twice in a '⊏' shape, thereby being extended toward the flange 30. In this case, the connection terminal 239 may be formed with three pieces to correspond to a three phase power terminal of the pump 7.

One end portion of the connection terminal 239 may be connected to the terminal 17 of the pump 7 and the other end portion thereof may be extended in a lower side direction of the pump 7. Further, the connection terminal 239 may be molded to cover an external surface.

In this case, an external surface of the connection terminal 239 may be molded with a plastic material such as a resin material. Further, the terminal guide 233 and the cover member 231 inject the molded connection terminal 239 into a mold to be injection molded.

Referring to FIG. 9, a relief sensor 241 may be coupled to one end portion of the terminal guide 233. In this case, in order to prevent an internal pressure of the pump 7 from rapidly increasing, the relief sensor 241 adjusts a pressure, thereby preventing the pump 7 from damaging.

In an upper end portion of the pump 7, a coupling groove 9 that is depressed in an inner direction may be formed. At an inner surface of the coupling groove 9, a terminal hole 13 of the pump 7 may be formed.

Further, in a central portion of the coupling groove 9, in order to enable a liquid to flow, an outlet 9*a* may be formed. In this case, a discharge pipe 19 is inserted into the outlet 9*a* to discharge a liquid through the outlet 9*a*.

That is, one end portion of the discharge pipe 19 may be inserted into the outlet 9*a* and the other end portion thereof may be connected to the relief sensor 241.

Further, at an outer circumferential surface of the discharge pipe 19, a sealing member (not shown) is installed to protect the urea aqueous solution 3 from penetrating to the terminal 17.

In the other end portion of the terminal guide 233, a second plug 236 that is protruded toward the flange 30 may be formed. In this case, at an upper surface of the flange 30, a second socket (not shown) that is coupled to the second plug 236 may be formed.

Figure 15:
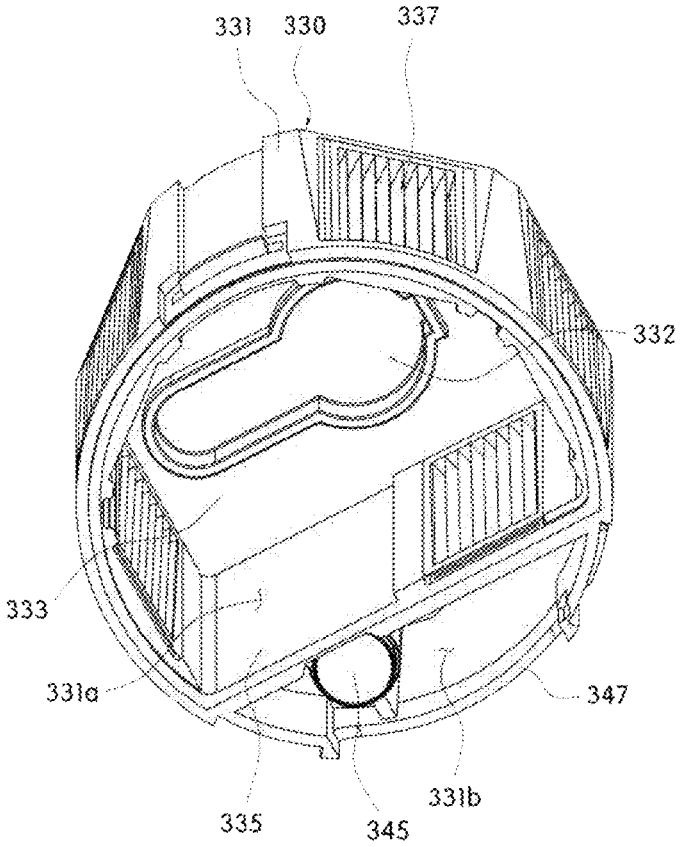
FIG. 15 is a bottom perspective view illustrating a filter of a pump module according to an exemplary embodiment of the present invention.
Figure 16:
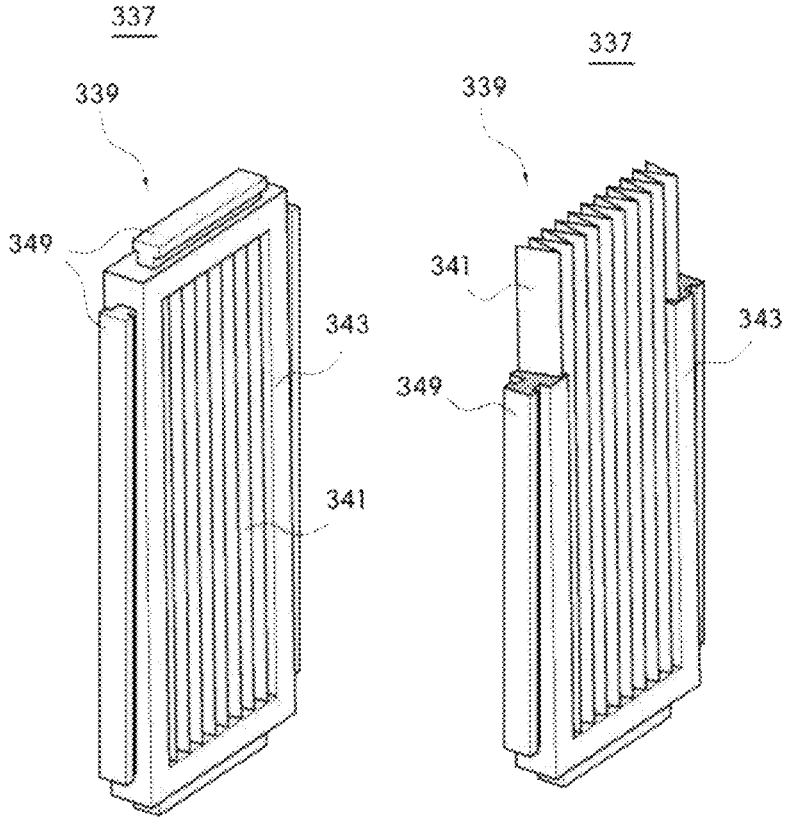
FIG. 16 is a perspective view illustrating a filter unit of a pump module according to an exemplary embodiment of the present invention.
Figure 17:
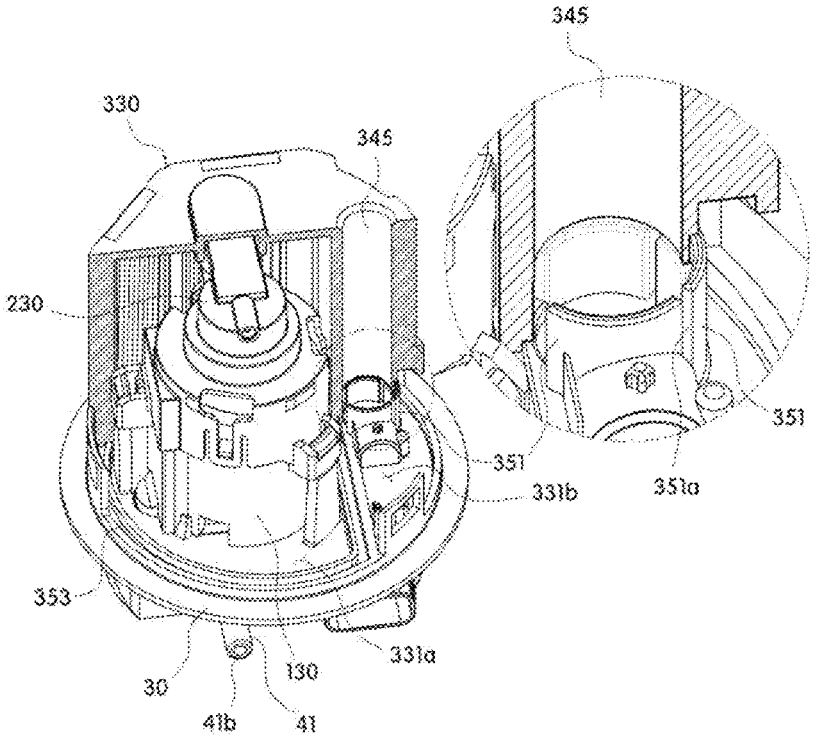
FIG. 17 is a perspective view illustrating the inside of a pump module in which a cover, a pump, a heater, and a filter are mounted according to an exemplary embodiment of the present invention.

FIG. 15 is a bottom perspective view illustrating a filter of a pump module according to an exemplary embodiment of the present invention. FIG. 16 is a perspective view illustrating a filter unit of a pump module according to an exemplary embodiment of the present invention. FIG. 17 is a perspective view illustrating the inside of a pump module in which a cover, a pump, a heater, and a filter are mounted according to an exemplary embodiment of the present invention.

In this case, referring to FIG. 17, in an exemplary embodiment of the present invention, the filter 330 is coupled on the flange 30 so as to enclose the pump 7, the heater 130, and the cover 230 to filter a liquid that is supplied to the pump.

Referring to FIGS. 15 and 16, in an exemplary embodiment of the present invention, the filter 330 may include a filter housing 331 and a filter unit 337. Thereby, in an exemplary embodiment of the present invention, the filter 330 filters the urea aqueous solution 3 that is stored within the tank 5 through the filter unit 337 to supply the urea aqueous solution 3 to the pump 7.

Referring to FIG. 17, the filter housing 331 may be coupled on the flange 30 that is installed at one surface of the inside of the tank 5, for example, at a lower surface of the inside of the tank 5. Further, within the filter housing 331, the pump 7, the heater 130, and the cover 230 may be installed.

In this case, at an outer circumferential surface of a lower portion of the filter housing 331, a third sealing member 353 may be installed. Thereby, the urea aqueous solution 3 may be injected into the filter housing 331 only through the filter unit 337. In this case, the filter unit 337 may have a filtration area of 450 $cm^2$ or more.

Further, the filter housing 331 has a shape similar to a cylindrical shape and may include an upper surface portion 333, a side surface portion 335, and a flow channel pipe 345. In this case, the upper surface portion 333 is located in an upper portion of the filter housing 331, and the side surface portion 335 is connected to the upper surface portion 333 to enclose a side surface of the pump 7.

Referring to FIG. 15, the filter housing 331 may have an insertion groove 332 at an inner side surface of an upper portion. The upper surface portion 333 of the cover 230 that is installed at the inside of the filter housing 331 may be inserted and fixed to the insertion groove 332.

In this case, the insertion groove 332 is located at the inside of the filter housing 331 and is formed to correspond to the upper surface portion 333 of the cover 230 to be insertion coupled.

Referring to FIG. 15, in an exemplary embodiment of the present invention, in the side surface portion 335, five surfaces are connected and thus the side surface portion 335 may be formed similar to a pentagon, and at each of five surfaces of the side surface portion 335, the filter unit 337 may be installed.

Thereby, in an exemplary embodiment of the present invention, when a vehicle having the filter 330 is inclined, particulates may be evenly filtered through the filter unit 337.

In order to couple to the flange 30, the filter housing 331 may include a coupling member 347. Thereby, in an exemplary embodiment of the present invention, the filter 330 may be separately coupled from the flange 30 without damage.

The coupling member 347 has a belt shape of a half-circle shape and is connected to the pentangular side surface portion 335 and thus a lower surface of the filter housing 331 may be formed in a circular shape.

In an exemplary embodiment of the present invention, a lower surface of the filter housing 331 including the coupling member 347 is formed in a circular shape and may be stably closely coupled to the flange 30 having a circular shape.

Referring to FIG. 17, in an exemplary embodiment of the present invention, at the inside of the filter housing 331, a flow channel pipe 345 that is opened in a vertical direction may be formed. In this case, the filter housing 331 may be separated into a first space 331*a* in which the pump 7, the heater 130, and the cover 230 are located and a second space 331*b* in which the flow channel pipe 345 is located. That is, the flow channel pipe 345 may be formed at an outer side surface of the side surface portion 335.

At one surface of the flange 30 that is connected to a lower end portion of the flow channel pipe 345, a level sensor 67 may be installed. The level sensor 67 is installed at the inside of the flange 30 to be sealed.

At the inside of the flange 30, the level sensor 67 is installed, and at an upper surface of the flange 30 in which the level sensor 67 is installed, a fourth wall portion 351 is formed to be connected to the flow channel pipe 345.

The fourth wall portion 351 may have a slit 351*a* that has a cylindrical shape and that is extended to the upper surface side. In this case, an end portion of the flow channel pipe 345 that is connected to the fourth wall portion 351 is formed to have a step portion in an inner direction to be supported by the fourth wall portion 351.

In this case, in the flow channel pipe 345, the urea aqueous solution 3 is filled, and the flow channel pipe 345 may be a passage through which ultrasonic waves may pass when ultrasonic waves are shot by an ultrasonic wave level sensor.

Referring to FIG. 15, in an exemplary embodiment of the present invention, the filter unit 337 of the filter 330 may be formed at one side, for example, at the side surface portion 335 of the filter housing 331. Thereby, in an exemplary embodiment of the present invention, the filter 330 may filter a liquid that is supplied to the pump 7.

The filter unit 337 may include a plurality of filter members 339. The plurality of filter members 339 may be radially arranged at a predetermined gap in the side surface portion 335.

Further, the plurality of filter members 339 may each include a filter medium 341 and a frame 343. In this case, the filter medium 341 that is formed in the plurality of filter members 339 may have a total filtration area of 450 $cm^2$ or more. Therefore, a life-span of the filter medium 341 may be extended.

The filter medium 341 may have a plane shape that is formed in a corrugated form. In the filter medium 341, particulates of 30 μm or more may filter by 99.9% or more.

In order to support the filter medium 341, the frame 343 may be installed at the circumference of the filter medium 341. In this case, at the circumference of the frame 343, a protruding portion 349 that is protruded in an external direction may be formed.

The protruding portion 349 has a T-shaped cross-section and may fix the filter member 339 including the protruding portion 349 to a mold, when producing the filter housing 331, and a filter housing may be produced with an insert injection method.

Figure 18:
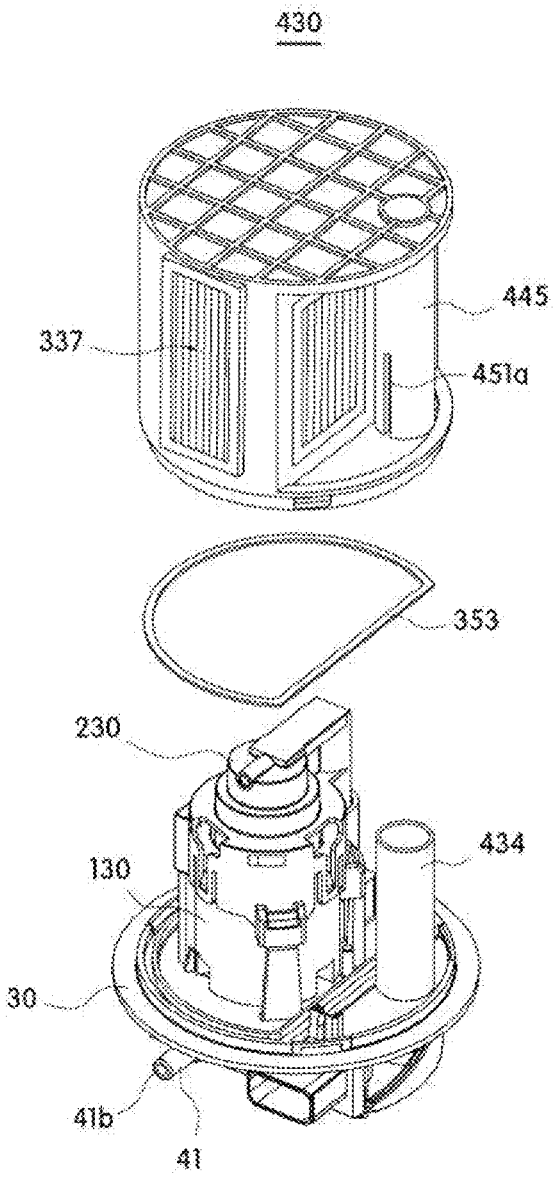
FIG. 18 is a perspective view illustrating an exemplary variation of a filter of a pump module according to an exemplary embodiment of the present invention.

FIG. 18 is a perspective view illustrating an exemplary variation of a filter of a pump module according to an exemplary embodiment of the present invention.

In an exemplary variation of the filter 330 of the pump module according to an exemplary embodiment of the present invention, only the difference of a filter 430 of the pump module according to an exemplary embodiment of the present invention will be described.

Referring to FIG. 9, a side surface portion of the filter housing 331 according to another exemplary embodiment of the present invention may be formed in a cylindrical shape. Further, the flow channel pipe 445 has a cylindrical shape and one end portion thereof may be connected to the flange 30 and the other end portion thereof may be connected to an upper surface of the filter housing 331.

In the flow channel pipe 445, an end portion that is connected to the flange 30 may include a slit 451*a* that is extended to the upper surface side of the filter housing 331. In this case, the urea aqueous solution 3 may be injected into the flow channel pipe 445 through the slit 451*a*.

Further, at an upper surface of the flange 30, a fourth wall portion 351 that is coupled to the flow channel pipe 445 may be formed. The fourth wall portion 351 may be inserted and be coupled to the flow channel pipe 445.

In a method of installing the pump module 1 according to an exemplary embodiment of the present invention, at the first groove 71 that is formed at a lower side surface of the flange body 31, the level sensor 67 is vertically installed, and at the second groove 73, the concentration sensor 69 is horizontally installed. Thereafter, the flange cover 33 is covered.

Further, the pump 7 is inserted and coupled to the third receiving groove 237 of the cover 230, and the heater 130 is inserted and coupled between the pump 7 and the cover 230.

Thereafter, by inserting the discharge pipe 43 into the second exhaust pipe 41 that is formed within the second receiving groove 37 that is formed at an upper surface of the flange body 31 and by coupling the first exhaust pipe 11 of the pump 7 to the discharge pipe 43, a cover that couples the pump 7 and the heater 130 is coupled to an upper surface of the flange body 31.

Thereafter, the filters 330 and 430 are coupled to an upper surface of the flange 30 so as to enclose the pump 7, the heater 130, and the cover 230 and are installed at the inside of the tank 5 in which the urea aqueous solution 3 is stored.

In an exemplary embodiment of the present invention, the first sealing member 243, the second sealing member 245, and the third sealing member 353 may be sealed so that the urea aqueous solution 3 is not penetrated to the pump module 1.

In this case, the first sealing member 243, the second sealing member 245, and the third sealing member 353 may be pressed with a predetermined compression ratio, may have a predetermined thickness, and may be produced in, for example, an O-ring form of a fluorine silicon material.

In the pump module according to an exemplary embodiment of the present invention, by coupling a pump, a heater, and a cover on a flange, the pump, the heater, and the cover may be fixed to the inside of a tank.

The pump module according to an exemplary embodiment of the present invention includes a cover member to cover a terminal of a pump, thereby protecting the terminal of the pump from a urea aqueous solution.

In the pump module according to an exemplary embodiment of the present invention, in a side surface portion, a filter portion is installed and thus when a vehicle is inclined, particulates may be evenly filtered through the filter unit.

The pump module according to an exemplary embodiment of the present invention includes a flow channel pipe, and a urea aqueous solution coupling structure body includes a first hole in a cover member, and when a volume of a urea aqueous solution expands due to freezing, the pump module can reduce a force in which an upper portion of a pump receives.

The pump module according to an exemplary embodiment of the present invention can stably pump a strongly basic urea aqueous solution to an injector.

The pump module according to an exemplary embodiment of the present invention includes a sealing member and can seal so that a urea aqueous solution does not penetrate to a pump terminal.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A pump module, comprising:

a pump installed at an inside of a storage tank to discharge a liquid that is stored at the inside of the tank to the outside of the tank;

a flange coupled to one side of the tank to couple the pump to the tank;

a heater located on the flange to enclose a lower portion of the pump;

a cover that covers an upper portion of the pump to couple the heater to the flange; and a filter coupled to the flange to enclose the pump, the cover, and the heater and that filters the liquid that is supplied to the pump, wherein the cover comprises:

a cover member that has a third receiving groove that houses a portion of the pump comprising a terminal of the pump at one side;

a terminal guide that is disposed in an outer portion of the cover member and in which a connection terminal that is connected and extended to the terminal is located therein; and a coupler that is disposed at one side of the cover member to couple the cover member to the flange.

2. The pump module of claim 1, wherein the flange comprises:

a flange body comprising a receiving portion that is installed at one surface of the inside of the tank and having one surface in which the pump is installed and the other surface in which a printed circuit board (PCB) is housed; and a flange cover that is coupled to the flange body to seal the PCB, wherein a first exhaust pipe of the pump that is installed in the flange body extends to the flange side and is connected to a second exhaust pipe that is formed at the other surface side of the flange body of the outside of the tank.

3. The pump module of claim 2, wherein the receiving portion comprises:

a first receiving groove in which the PCB and the second exhaust pipe are installed; and a first wall portion that is formed at the circumference of the first receiving groove, wherein the first wall portion is coupled to the flange cover.

4. The pump module of claim 3, wherein the first wall portion comprises:

a first surface having a penetration hole that inserts and penetrates into one end portion of the second exhaust pipe; and a second surface that forms the first receiving groove together with the first surface by connecting both end portions of the first surface.

5. The pump module of claim 4, wherein a height of the first surface is higher than that of the second surface, the first surface has a constant height, and a height of the second surface reduces in a predetermined angle as receding from the first surface.

6. The pump module of claim 5, wherein the second surface has a round shape, and the predetermined angle is 5° to 20°.

7. The pump module of claim 3, further comprising:

an installation groove that is formed to insert the PCB at one surface of the first receiving groove;

a second wall portion that is formed at the circumference of the installation groove; and a PCB cover that couples to the second wall portion to cover and seal the PCB.

8. The pump module of claim 7, wherein at one surface of the installation groove, a first groove into which a level sensor is inserted and a second groove into which a concentration sensor is inserted are formed, and in an upper portion of the level sensor and the concentration sensor, the PCB is installed.

9. The pump module of claim 2, wherein at one surface of the flange cover, a mounting hole is formed, wherein the pump module further comprises a ventilation member that is inserted and fixed to the mounting hole.

10. The pump module of claim 2, wherein the heater has a first mounting groove that houses at least a portion of the pump and heats at least a portion of the pump and at least a portion of the first exhaust pipe and the second exhaust pipe.

11. The pump module of claim 10, wherein the heater comprises:

a heater body that extends in an inner direction of the tank; and a positive temperature coefficient (PTC) element that is coupled to an outer side surface of the heater body, wherein the first mounting groove is formed in an end portion that is opened in an inner direction of the tank of the heater body.

12. The pump module of claim 11, wherein the heater body comprises:

a third wall portion that is formed at the circumference of a second mounting groove that is formed at one side surface of the heater body in order to insert the PTC element; and a PTC cover that is coupled to the heater body in order to cover and seal the PTC element, wherein the PTC cover is coupled to the third wall portion to cover and seal the PTC element and to fix the PTC element to the heater body.

13. The pump module of claim 2, wherein at the one surface of the flange, a second receiving groove is formed to house at least a portion of the first exhaust pipe, and at the second receiving groove, one end portion of the heater body that can heat at least a portion of the first exhaust pipe is housed together with at least a portion of the first exhaust pipe.

14. The pump module of claim 13, wherein at the inside of the second receiving groove of the flange, a connection pipe that connects the first exhaust pipe and the second exhaust pipe that extend and protrude in the heater direction is formed, wherein the pump module further comprises a straight line type ejection pipe that is coupled to the first exhaust pipe, and the ejection pipe is located within the connection pipe in a state that is coupled to the first exhaust pipe.

15. The pump module of claim 1, wherein a terminal of the pump is formed at an upper side surface of an upper end portion of the pump, both ends of the connection terminal are bent to extend to the flange side, and one end portion thereof is connected to a terminal of the pump, and the other end portion thereof extends in a lower side direction of the pump.

16. The pump module of claim 15, wherein in the pump, a first diameter of an upper end portion in which a terminal of the pump is formed is smaller than a second diameter of a central portion of the pump, and the inside of the third receiving groove of the cover member has a step portion to correspond to a first diameter of an upper end portion of the pump and a second diameter of a central portion of the pump.

17. The pump module of claim 16, wherein at the third receiving groove of the cover member, a first sealing member and a second sealing member corresponding to the first diameter and the second diameter, respectively, are installed.

18. The pump module of claim 1, wherein at one surface of the pump, a terminal hole is formed, at the inside of the terminal hole, the terminal is located, and the terminal hole and an end portion of the connection terminal are coupled with shape customization.

19. The pump module of claim 18, wherein a relief sensor is coupled to one end portion of the terminal guide, in an upper end portion of the pump, a coupling groove that is depressed in an inner direction is formed, at an inner surface of the coupling groove, a terminal hole of the pump is formed, and in a central portion of the coupling groove, an outlet in which the liquid may flow is formed.

20. The pump module of claim 19, further comprising a discharge pipe having one end portion that is inserted into the outlet and the other end portion that is connected to the relief sensor.

21. The pump module of claim 1, wherein an upper portion of the heater extends to the inside of the third receiving groove so as to enclose an upper portion of a side surface of the pump and is disposed between the cover members of the pump.

22. The pump module of claim 1, wherein at an outer side surface of the heater, a coupling protrusion that protrudes to the cover member side is formed, and in the cover member, a first hole that inserts and couples the coupling protrusion is formed.

23. The pump module of claim 1, wherein the coupler comprises a latch jaw that protrudes to the pump side and having an end portion to protrudes in an outside direction, and in the cover member, a second hole in which the latch jaw is inserted and coupled is formed.

24. The pump module of claim 1, wherein the filter comprises:

a filter housing that is coupled on the flange that is installed at one surface of the inside of the tank and that forms a hollow portion therein to install the pump therein; and a filter unit that is formed at one side of the filter housing and that filters the liquid that is supplied to the pump.

25. The pump module of claim 24, wherein the filter housing is formed in a cylindrical shape and comprises an upper surface portion that is located in the upper portion of the pump; and a side surface portion that encloses a side surface of the pump.

26. The pump module of claim 25, wherein the filter unit comprises a plurality of filter members, each of the plurality of filter members comprises:

a plane-shaped filter medium that is formed in a corrugated form; and a frame that is installed at the circumference of the filter medium in order to support the filter medium.

27. The pump module of claim 26, wherein the plurality of filter members are radially arranged at a predetermined gap in the side surface portion.

28. The pump module of claim 27, wherein at an inside of the filter housing, a flow channel pipe that is opened in a vertical direction is formed, and at one surface of the flange that is connected to a lower end portion of the flow channel pipe, a level sensor is installed.

29. The pump module of claim 24, wherein the filter unit has a filtration area of 450 $cm^2$ or more.

* * * * *